United States Patent [19]

Forbes, Jr.

[11] 4,190,191

[45] Feb. 26, 1980

[54] SLIDING LID FOR FLANGED TRAY

[75] Inventor: Hampton E. Forbes, Jr., Wilmington, Del.

[73] Assignee: Westvaco Corporation, New York, N.Y.

[21] Appl. No.: 969,232

[22] Filed: Dec. 13, 1978

[51] Int. Cl.[2] ..... B65D 43/00; B65D 77/00; B65D 5/64

[52] U.S. Cl. ..... 229/43; 206/464; 206/468

[58] Field of Search ..... 229/43, 9, 10, 11; 206/468, 462, 464

[56] References Cited

U.S. PATENT DOCUMENTS

| | | | |
|---|---|---|---|
| 136,973 | 3/1873 | Cutler . | |
| 2,030,134 | 2/1936 | Burgener | 229/7 |
| 3,104,759 | 9/1963 | Hansen | 206/464 X |
| 3,157,280 | 11/1964 | Perdue et al. | 206/468 |
| 3,464,544 | 9/1969 | Franck | 206/468 |
| 3,467,248 | 9/1969 | Makowicki | 206/462 X |
| 3,504,843 | 4/1970 | McCrea | 229/45 |
| 3,580,478 | 5/1971 | Bemiss | 229/43 |
| 3,863,832 | 2/1975 | Gordon et al. | 229/30 |
| 3,865,302 | 2/1975 | Kane | 229/43 |
| 3,876,133 | 4/1975 | Smith | 229/43 |
| 3,927,820 | 12/1975 | Wagner et al. | 206/468 |
| 4,019,675 | 4/1977 | Andersson et al. | 229/43 X |

FOREIGN PATENT DOCUMENTS

| | | | |
|---|---|---|---|
| 1309691 | 3/1973 | United Kingdom | 206/468 |
| 1384547 | 2/1975 | United Kingdom | 206/468 |

*Primary Examiner*—Davis T. Moorhead

[57] ABSTRACT

A sliding lid is disclosed for use on flanged trays. The lid is prepared from a blank of flexible material such as paperboard or the like and includes side panels which are folded and glued to provide slide channels for accepting the tray flange. The blanks are cut and scored to include integral guides at the leading edges of the slide channels for accepting the tray flange and friction locking means which cooperate with the sides of the tray to retain the lids in place. The lids are intended for use on ovenable trays for packaging and cooking food.

5 Claims, 7 Drawing Figures

SLIDING LID FOR FLANGED TRAY

BACKGROUND OF THE INVENTION

The present invention relates to the food packaging art, and more particularly to a sliding lid closure for a container for packaging food.

There is a considerable market for low cost, disposable containers for packaging food wherein the containers protect the food packaged therein during transportation and refrigeration, and additionally, may be used for heating and serving the food. Moreover, with the development of thermally stable polymers and paperboard for use in conventional and microwave ovens, disposable food packages prepared from such materials are finding increased popularity.

In general, containers of the class described disclosed in the prior art comprise trays or the like which may be prepared on high speed forming equipment. Some of these trays include integral closure tops, but most utilize separate closure members that in most cases are adhered to a flange element around the edge of the tray. In those cases where the tray tops are adhered to the tray and it is desired to heat the contents of the tray, problems occur when, upon heating, the contents generate gases which must be released. Obviously, if the internal pressures created by the gases are not relieved, the tray may be unattractively deformed and may burst. To avoid these undesireable results, the prior art teaches several methods based on the timely venting of the container. These methods include the use of heat sensitive adhesives for bonding the top closure lids to the tray and meltable plugs which dissolve at high temperatures to provide a vent. In other cases, the tray lid is designed to expand to create an internal space within the container to relieve the increased pressure. And in still other cases, the lids remain sealed to the tray during the entire heating process. Thus, although the prior art teaches products similar to the product disclosed herein, most have been found to be unreliable and difficult and/or expensive to manufacture. Accordingly, in order to overcome the difficulties of the prior art, the present invention discloses a sliding lid for such trays wherein the lid forms a snug but not a pressure tight fit on the tray. Because of this loose fit feature, the contents of the tray can readily be heated without creating problems. Moreover, since the lid of the present invention is easily applied and removed, it is more versatile and finds greater utility than the lids disclosed in the prior art.

SUMMARY OF INVENTION

The food packaging container of the present invention includes a flanged tray and a slide top lid, both of which are preferably, although not necessarily, constructed from paperboard having a thermoplastic, thermally stable coating at least on the interior surfaces thereof. The tray is formed with a generally rectangular base portion with upstanding side walls which are finished at the edges thereof with a horizontally disposed peripheral flange. Such trays are generally referred to as pressed trays as manufactured, for instance, on Peerless Machine & Tool equipment. The trays are formed in a variety of sizes as desired, and are used for, among other things, carryout trays, frozen food containers, single serving institutional packages and most recently for ovenable food packages. As noted hereinbefore, the trays are generally coated on their interior food contacting surfaces with a thermally stable, thermoplastic coating such as a polyester and are printed on their exterior surfaces with graphics suitable for the food packaged. Meanwhile, the slide top lids of the present invention may also have a similar coating on their interior or food contacting surfaces and are similarly printed with suitable graphics on their exterior surfaces.

The slide top lids are formed from generally rectangular blanks of paperboard and comprise a central panel with hingedly attached side panels at two opposed sides thereof. The side panels are arranged to be folded over and adhered to the interior surface of the lid so as to form a pair of slide channels which coincide precisely with the tray flange at two sides of the tray. The side panels are shaped at the ends thereof to provide guides for accepting the flanges at each side of the tray, and are shaped along their inside edges to provide integral locking means for locking the lids in position on the trays.

In the preferred embodiment, there is provided at least two or a pair of side panels at each side of the lid central portion. In this manner, the paired side panels at each side of the lid may be folded over upon themselves before the outermost panel is adhered to the lid interior surface to provide better defined slide channels for accepting the flanges at each side of the tray.

After the lid is formed and slid onto the tray, only a loose fit is achieved which is satisfactory for protecting the contents against contamination and also provides a means for allowing excess gases to escape when the contents are heated in an oven, either of the conventional or microwave type.

DESCRIPTION OF DRAWING

FIG. 6 illustrates a bottom view of the finished lid formed from the blank of FIG. 4; and, FIG. 7 is a bottom view of a tray with the sliding lid of the present invention in place.

DETAILED DESCRIPTION

Figure 1:
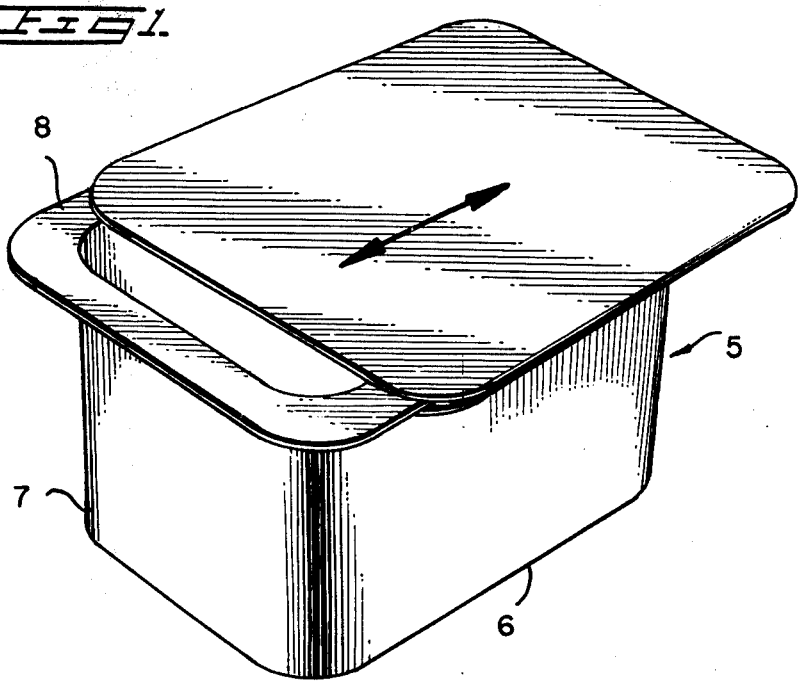
FIG. 1 is a perspective view of the sliding lid of the present invention being slid onto a rectangularly flanged open top tray.
Figure 2:
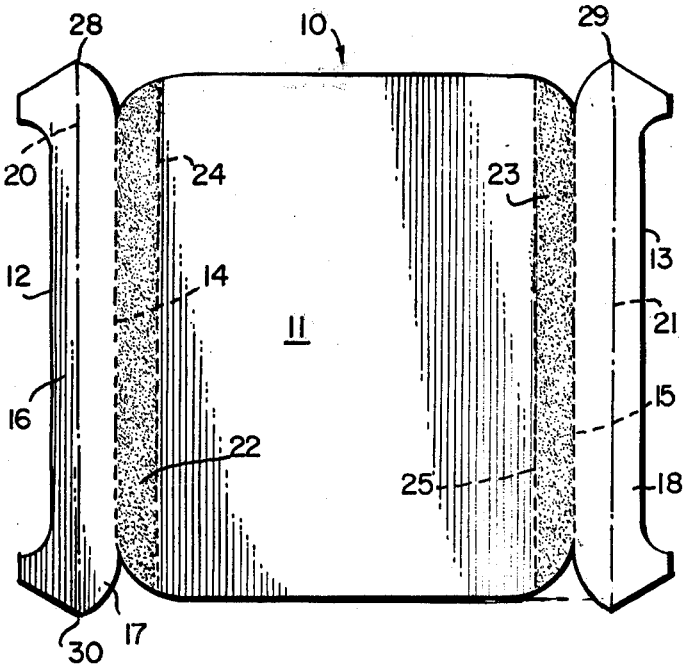
FIG. 2 is a plan view of a typical blank structure from which the sliding lid may be formed.
Figure 3:
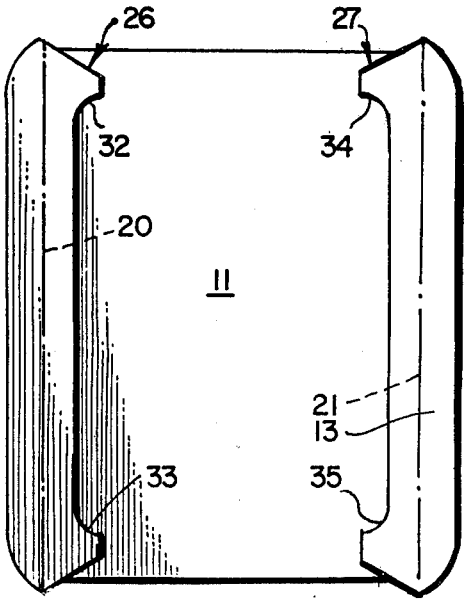
FIG. 3 shows a bottom view of the finished lid formed from the blank of FIG. 2.

Referring now to the drawings herein, the sliding lid embodiment of the invention illustrated in FIGS. 2 and 3 comprises a generally rectangular blank of paperboard or the like 10 which has a rectangular central panel 11, and attached at two opposed sides thereof a pair of side panels 12 and 13 along score lines 14 and 15. The width of the central panel 11 between the fold lines 14,15 is slightly wider than the width of the flanged tray for which the lid is intended. The extra width is necessary to permit the side panels 12 and 13 to be folded and adhered to the central portion 11 and still leave enough space therebetween for forming the slide channels which accept the tray flanges. As shown in FIG. 1, a typical tray construction 5 includes a bottom 6 with integral side walls 7 and a rectangularly flanged top 8.

In order to form the lid slide channels at each side of the blank 10, the side panels 12,13 are each divided into two portions 16,17 and 18,19 respectively by embossed lines 20 and 21. The portions 17 and 19 of side panels 12 and 13 are arranged adjacent to the fold lines 14 and 15, and like portions 22,23 are described in the lid central portion 11 by a second pair of embossed lines 24,25. The embossed lines are provided in the blank substantially as fold lines, but primarily to give the panels flexibility where desired. Meanwhile, the portions 17,22 and 19,23 at each side of the blank are applied with adhesive, and when the panels 12,13 are folded about their respective fold lines 14,15, the portions 17 and 22, and 19 and 23 become adhered to one another. In so doing, the portions 16 and 18 of side panels 12,13 are left free to form the slide channels 26,27 between the portions 16 and 18 and central portion 11.

For guiding the tray flange into channels 26,27, the side panels 12 and 13 have shaped leading edges 28,29 and 30,31 which may extend slightly beyond the extreme edges of the tray lid when the flaps 12,13 are folded over and adhered as shown in FIG. 3. Similarly, for locking the tray lid in position on the tray, the portions 16 and 18 of flaps 12 and 13 each are provided with curved after sections 32,33 and 34,35 located adjacent to and slightly behind the shaped leading edges. The curvature of the after sections is shaped to correspond to the curvature of the corners of the tray and fit snugly against the corners after the lid is slid into place. In this manner the lid is provided with guides for correctly aligning the slide channels 26,27 onto the tray flange, and, locks for substantially stopping any undesired off center movement of the lid once it is slid onto the tray.

Figure 4:
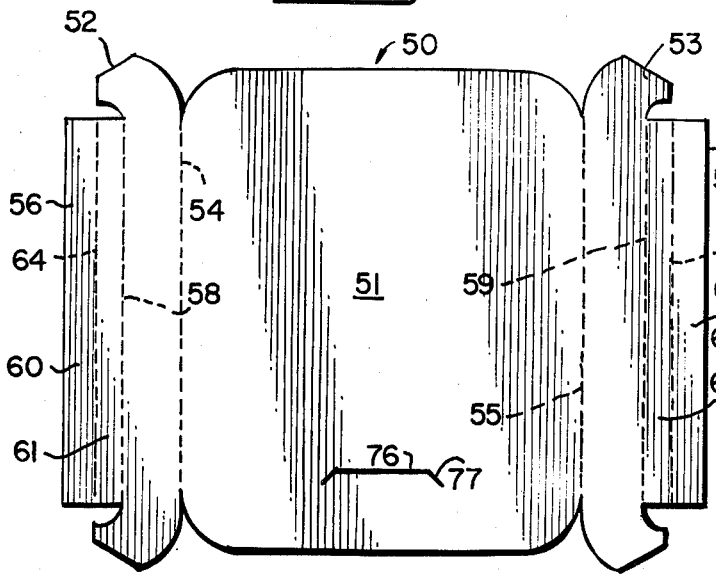
FIG. 4 shows a plan view of a modified blank structure for forming the lids of the present invention.
Figure 8:
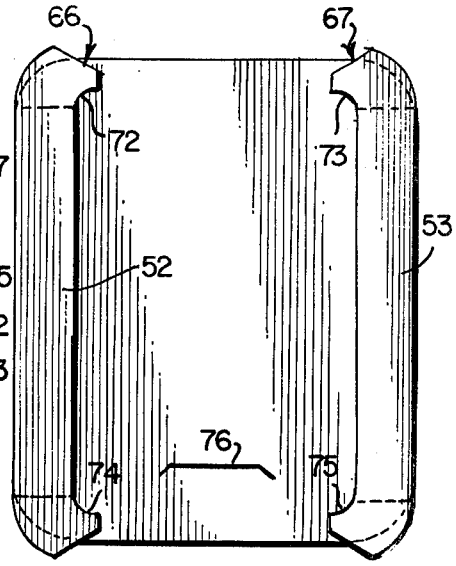
Figure 5:
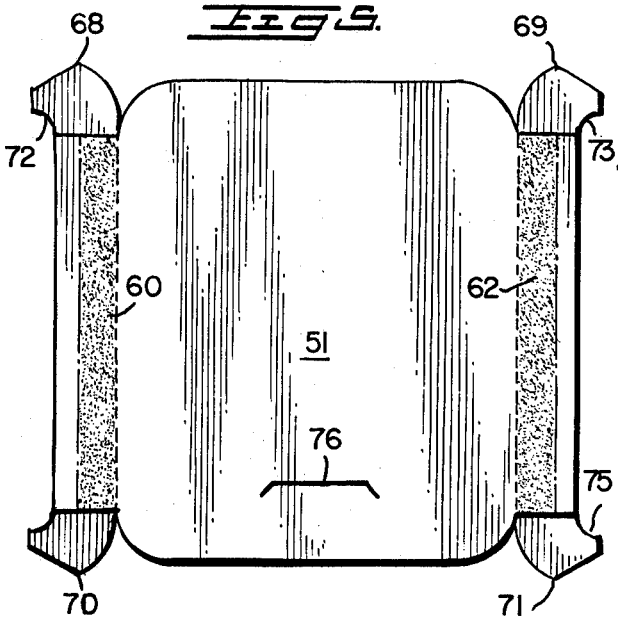
FIG. 5 shows an intermediate step in the formation of a lid from the blank of FIG. 4.
Figure 7:
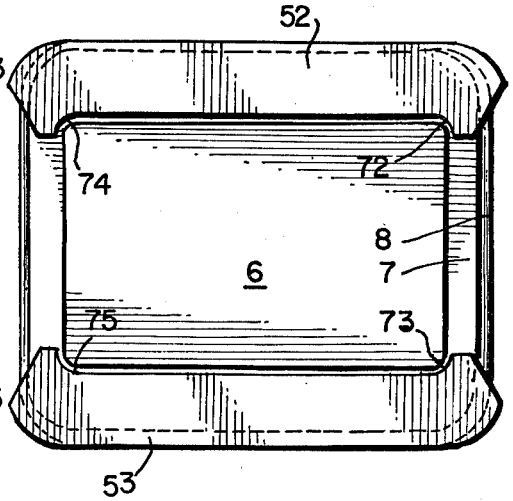

FIGS. 4–6 illustrate another embodiment of the sliding lid of the present invention wherein the lid includes paired flaps at each side thereof for forming the slide channels of the lid. This embodiment is particularly useful where the tray lids are prepared from paperboard that has a coating on one side only. In general it is difficult to adhere two similarly coated surfaces together. Thus, for a typical uncoated blank as shown in FIGS. 1 and 2, only a single fold for the side panels is required. However, if the blank of FIGS. 1 and 2 was coated, special adhesives would be required to complete the construction. On the other hand, as shown in FIGS. 3–5, the substantially identical final construction can be achieved with a coated one side blank by adding a second flap at each side of the blank, which flap is folded around to adhere an uncoated surface to a coated surface of the blank. For this purpose, the blank 50 in FIG. 4 is provided with a central panel 51, a first pair of side flaps 52,53 foldably connected thereto along fold lines 54,55 and a second pair of side flaps 56,57 foldably connected to the first side flaps along fold lines 58,59. The width of the respective side flaps is substantially equal with the second pair of side flaps being divided into two portions 60,61 and 62,63 by embossed lines 64,65. The embossed lines are provided to give the flaps flexibility in the desired places and to define the area where adhesive is applied to form the lid. FIG. 5 shows an intermediate step in the manufacture of the lid wherein the second pair of side flaps 56,57 are folded over so that adhesive can be applied to the outer portions thereof 60,62. After adhesive is applied to the uncoated side of portions 60,62, the flaps are folded over once again about score lines 54,55 to adhere the uncoated surfaces of flap portions 60,62 to the coated interior surface of central panel 51. The final lid is shown in FIG. 6 wherein it may be seen that it is substantially identical to the sliding lid illustrated in the embodiment of FIGS. 2–3.

As in the case of the first embodiment, the folding sequence provides a pair of flange accepting channels 66,67 at each side of the blank that are formed between the interior of central portion 51 and the inner portions 61,63 of the second pair of side flaps 56,57. In addition, it will be noted that the shaped leading edges 68,69 and 70,71 of the second pair of side flaps 52,53 serve as guide means for accepting the flanges of the tray while the curved after sections 72,73 and 74,75 act as effective locks to center and retain the sliding lid on the tray. Moreover, where an extra lock is desired, the blank may include a locking tab element 76 formed by a cut line 77 at one end of the blank. The locking tab in operation is designed to catch and retain an edge of the tray flange when the lid is slid into position.

Although the container shown in the drawings is a rectangular tray-like container, the concept of the present invention is not so limited. The sliding lid disclosed herein could be used on a container of any shape as long as it has a rectangularly flanged top. The container could have, for instance, a cylindrical base or any other desired shape. In addition, the material of construction is not critical to the present invention although the preferred material is paperboard, or thermally stable paperboard, or coated thermally stable paperboard. However, in general, the sliding lid disclosed herein could be formed from any material capable of being prepared in blank form and then shaped into its lid configuration. On the other hand, the construction material must have sufficient strength to provide enough rigidity to the lid to prevent it from collapsing or tearing in use.

Accordingly it may be seen that the invention is fully disclosed herein with at least two embodiments. However, it will be appreciated that other container constructions may be devised which nevertheless come within the scope of the invention as defined in the appended claims.

I claim:

1. A sliding lid for a flanged, open top tray comprising, a rectangularly shaped central panel including side panels foldably attached at two opposed sides thereof wherein the width of the side panels is sufficient to provide, when folded adjacent to said central panel, first portions which are fixedly attached to said central panel in the region adjacent to the foldable connections thereto and second unattached portions which form with said central panel a pair of slide channels for accepting the tray flange at two sides of said tray, the improvement wherein said side panels comprise first and second pairs of foldably attached panels, said first pair of side panels having a length that is substantially equal to the length of the central panel sides to which they are attached and said second pair of side panels having a length less than that of the first pair of side panels and a width substantially equal to that of the first pair of side panels, said second pair of side panels being divided into two portions by embossed lines which extend along the length of said panels and bisect the panels into two substantially equally sized portions, so that when said second pair of side panels are folded over upon themselves adjacent to said central panel, and portions thereof adjacent to the foldable connection between said first side panels and said central panel are adhered together, the unattached portions remain free to form said pair of slide channels for accepting the tray flange at two sides of said tray.

2. The sliding lid of claim 1 wherein said first side panels have shaped leading edges at each end thereof which serve as guide means for aligning the slide channels with the top flanges of said tray.

3. The sliding lid of claim 2 wherein the first side panels further have curved after sections located adjacent to and slightly behind the shaped leading edges thereof which serve as locking means for gripping the corners of said tray to retain the lid in position on said tray.

4. The sliding lid of claim 3 wherein the lid includes an additional locking means at one end thereof comprising a tab element formed by an arcuate cut applied to said central panel which tab element grips the flange at one end of said tray.

5. A container for packaging, storing and heating food comprising, in combination, an open top, flanged tray and a sliding lid for said tray, the improvement wherein said lid comprises a rectangularly shaped central panel and at least two pair of side panels foldably attached at two opposed sides of said central panel, said first pair of side panels having a length that is substantially equal to the length of the central panel sides to which they are attached and said second pair of side panels are attached to said first pair of side panels and have a length less than that of the first pair of side panels and a width substantially equal to that of said first pair of side panels, wherein said first pair of side panels have shaped leading edges at each end thereof and curved after sections located adjacent to and slightly behind said leading edges, and said second pair of side panels are divided into two substantially equally sized portions by embossed lines that extend along the length thereof, so that, when said second pair of side panels are folded over upon themselves in juxtaposition to said central panel and like portions thereof are adhered to the central panel adjacent to the foldable connection between said first side panels and said central panel, the unattached portions form a pair of slide channels with said central panel for accepting the tray flange at two sides of said tray while the shaped leading edges of said first side panels serve as guide means for aligning the slide channels with the tray flanges and the curved after sections serve as locking means for gripping the corners of said tray to retain the lid in position on said tray.

* * * * *